United States Patent [19]

Hill et al.

[11] 4,052,257

[45] Oct. 4, 1977

[54] METHOD OF PRODUCING GLASS MATS

[75] Inventors: Homer G. Hill, Newark, Ohio; Kenneth L. Austin, College Station, Tex.

[73] Assignee: Owens-Corning Fiberglas Corporation, Toledo, Ohio

[21] Appl. No.: 647,488

[22] Filed: Jan. 8, 1976

Related U.S. Application Data

[63] Continuation of Ser. No. 528,295, Nov. 29, 1974; abandoned.

[51] Int. Cl.[2] ..... C03B 25/02; C04B 43/02

[52] U.S. Cl. ..... 162/156; 65/3 C; 162/158; 162/175; 428/268; 428/325

[58] Field of Search ..... 65/3 C; 162/156, 158, 162/175; 428/268, 325

[56] References Cited

U.S. PATENT DOCUMENTS

| | | | |
|---|---|---|---|
| 3,224,927 | 12/1965 | Brown et al. | 162/175 X |
| 3,395,071 | 7/1968 | Nitzche et al. | 162/156 |
| 3,454,454 | 7/1969 | Sterman et al. | 428/268 |
| 3,458,395 | 7/1969 | Stalker | 162/175 |
| 3,471,362 | 10/1969 | Kent | 162/175 |

*Primary Examiner*—Robert L. Lindsay, Jr.

*Attorney, Agent, or Firm*—John W. Overman; Philip R. Cloutier; Dennis M. Kozak

[57] ABSTRACT

A size and dispersion system for, and a method for, the production of glass mats, the size comprising a methyl trimethoxysilane and a malto-dextrin, the dispersion system comprising a nonionic guar gum and an isostearic amide.

10 Claims, No Drawings

METHOD OF PRODUCING GLASS MATS

This is a continuation of Application Ser. No. 528,295 filed Nov. 29, 1974, now abandoned.

This invention relates to the production of glass mats. In one of its more specific aspects, this invention relates to a size and dispersion system for, and a method for, the production of glass mats.

The preparation of cellulose sheets in the form of paper is well known. Attempts have been made to form comparable sheets of glass fibers but such attempts have been generally unsuccessful for a number of reasons.

In the productionn of glass fibers, it is customary to size the fibers to facilitate their subsequent handling. Frequently, the presence of the size acts to prevent the uniform dispersion of the glass fibers in the aqueous dispersion system which the glass paper is laid down inasmuch as the size iterferes with the wetting of the glass fibers by the water, or the size tends to bond the glass fibers together and to prevent their uniform dispersal to form a mat or paper of substantially uniform thickness.

Relatedly, the nature of the water in which the fibers are dispersed, and which is drained from the fibers in the paper formation step, can be such that uniform dispersion of the fibers in the aqueous dispersion system is difficult to obtain. As a result, the paper which is formed is of irregular construction in that voids exist at certain areas with agglomeration of fibers existing at other areas.

Various methods have been developed to solve these problems. Some of these methods have related to the size system. Other methods have related to the aqueous dispersion system from which the glass is laid down. However, such methods have generally resulted in increased equipment costs in that these methods have involved usage of other than neutral pH solutions and, accordingly, require equipment constructed of materials resistant to such solutions.

The present invention solves these problems by providing a method and a dispersion system which enables the substantially uniform dispersion of any quality glass fibers in a tap-water-based aqueous system to produce a substantially uniform wetlaid glass mat. In general, the invention can be used with any of the prior art methods of laying down the glass mat; that is, glass fibers containing a size in contact with at least a portion of their surface, are suspended in the aqueous system to form a substantially uniform suspension and water is withdrawn from the glass fibers to produce a continuous, substantially uniform layer of glass fibers in the form of a glass mat or paper. The glass mat is dried and recovered.

More specifically, this invention involves sizing a plurality of glass fibers with a size comprising a silane and a malto-dextrin and, optionally, a polyvinyl acetate. The sized fibers are then uniformly dispersed in an aqueous system comprising a thickener and a cationic surfactant. The glass fibers are caused to settle to form a sheet of substantially uniform thickness. The aqueous medium is withdrawn and the sheet of glass fibers is recovered and dried. As used herein, the term "dispersion system" will refer to a composite comprising water, the thickener, the cationic surfactant and the sized glass fibers.

This invention can be carried out employing any glass fibers conventionally employed to form glass mats. Preferably, the glass fibers will have a diameter within the range of from about 0.0025 inch to about 0.0050 inch and will have a length of about 0.25 to about 0.5 inch. The fibers can be employed either in the form of individual slivers, in the form of roving, or in the form of yarns.

The size will comprise an aqueous-based composition comprising a silane, a multo-dextrin and, optionally, a polyvinyl acetate.

Any suitable silane can be employed. Preferably, the silane will be methyl trimethoxysilane. The silane will be employed in the size in an amount within the range of from about 0.005 to about 0.5 weight percent based upon the total weight of the size. In the best mode of practicing the invention, the silanewill be employed in an amount of about 0.1 weight percent.

One suitable silane is methyl trimethoxysilane as available from Dow Corning under the designation "Z6070". This material comprises a solution of the silane, the solution having a specific gravity of 0.94, a refractive index of 1.37, a color (ATHA) of 100, a flash of 50° C and a boiling point of 103° C at 760 mm. The silane has a molecular weight of 136.

Any suitable malto-dextrin can be employed. Preferably, the malto-dextrin will have a dextrose equivalent of about 10. The malto-dextrin will be employed in the size in an amount within the range of from about 5 to about 20 weight percent based upon the total weight of the size. In the best mode of practicing the invention, the malto-dextrin will be employed in an amount of about 10 weight percent.

One suitable malto-dextrin is Mar Rex 1918 available from Corn Products Company. This material is a water-soluble powder having a dextrose equivalent of about 10.

Optionally, any suitable polyvinyl acetate can be employed. The polyvinyl acetate can be employd in the form of a colloidal-stabilized emulsion, the polyvinyl acetate having a glass transition temperature of about 25° C. The polyvinyl acetate will be employed in an amount up to about 4 weight percent based upon the total weight of the size. In the best mode of practicing the invention, the polyvinyl acetate will be employed in an amount of about 2 weight percent.

One suitable polyvinyl acetate in Resyn 25-1014 available from National Starch and Chemical Corporation. This material is a colloidal-stabilized emulsion of large particle size, low to medium molcular weight polyvinyl acetate, the solution having a solids content of about 55%, a viscosity of 80 cps. at 72° F., a pH of about 4.5, a surface tension of about 36 dynes/cm. and is anionic. The polyvinyl acetate has a Tg of about 24° C and a minimum film fusion temperature of about 10° C.

The size composition can employ any suitable tap water in contrast to deionized water which is generally employed in size compositions. Tap waters high in calcium and magnesium and containing iron and manganese can be used. The pH of the tap water can be within the range of from about 6 to about 9.5.

The same or similar tap water can be used in the dispersion system in which the glass fibers will be dispersed in an amont within the range of from about 0.05 to about 0.75 weight percent, based upon the total weight of the dispersion. Preferably, the glass fibers will be dispersed in an amount within the range of from about 0.4 to about 0.5 weight percent.

The aqueous dispersion system will comprise a thickener and a cationic surfactant.

Any suitable thickener can be employed. Preferably, the thickener will be a nonionic guar gum and will be present in the dispersion system in an amount within the range of from about 0.1 to about 1% by weight based upon the total weight of the dispersing system. In the best mode of practicing the invention, the thickener will be present in the dispersing system in an amount of about 0.4 weight percent.

One suitable thickener is Jaguar A-20D, a nonionic guar gum available from Stein, Hall and Co., Inc.

Any cationic surfactant can be employed. Preferably, the suractant will be an isostearic amide, with isostearic dimethanol amide being employed in the preferred embodiment. The isostearic amide will be employed in an amount within the range of from about 0.01 to about 0.05 weight percent, based upon the total weight of the dispersion system. In the best mode of practicing the invention, the isostearic amide will be employed in an amount of about 0.025 weight percent.

One particularly suitable surfactant is Monamid 150-IS, available from Mona Chemical Co. This material is a liquid comprising isostearic dimethanol amide, the amide having a molecular weight of about 370. The solution in which the amide is contained has a specific gravity of about 0.96 at 20° C, an acid number of 5 to 10 and an alkali number of about 45 to about 60.

The size can be prepard by dissolving the malto-dextrin in a mix tank containing one half of the total water employed. The polyvinyl acetate is added to one-fourth of the total water and the resulting solution is introduced into the malto-dextrin solution. Acetic acid in an amount of about 0.027 weight percent of the finished size is added to one-eighth of the total water employed and the silane is introduced thereinto. After stirring the silane solution for about 30 minutes, the silane solution is added to the solution in the mix tank. The contents of the mix tank are then stirred for about 10 minutes, at the end of which period the size is ready for application to the fibers.

The size is applied to the fibers employing conventional application equipment in any conventional manner. Preferably, the size is applied on forming, the glass fibers being drawn into contact with a size applicator to which the size is fed. The size is deposited on the fibers in an amount within the range of from about 0.5 to about 1 percent by weight, on a dry basis, based upon the total weight of the size and the fiber. The fibers are dried after which they are gathered as roving in which form they are dispersed to form the dispersion system.

The dispersion system can be prepared by adding the amide, as a 1 percent aqueous solution solubilized with acetic acid, to the total quantity of water and agitating until a uniform composite results. About 1 part of acetic acid per 300 parts by weight of water is required.

The thickener is added to the solution thus formed just prior to use. The thickener is added in the amount previously stated such that a solution having a viscosity of about 100 cp. The glass fibers are introduced into this aqueous system in any suitable manner with agitation and the resulting aqueous composition should have a water freeness value lower than 300 Canadian Standard Units.

The best mode of practicing the invention and test results comparing the size of the invention with other sizes, in a common dispersion system comprising the aqueous dispersion system of the invention, are shown below. In all instances, the dispersion system comprised a nonionic guar gum and an isostearic amide.

EXAMPLE I

In each instance, glass fibers, chopped from roving comprising about 816 filaments per fiber were dispersed in a dispersion system.

The fibers were made from E glass and the filaments had diameters within the range of from about 0.0025 to about 0.0030 inch and legnths of about ¼ inch. The fibers were dispersed, with agitation, at a concentration of about 0.5 weight percent in the dispersion system. The dispersion system comprised a nononic guar gum at a concentration of about 0.4 weight percent ad an isostearic amide at a concentration of about 0.025 weight percent A series of dispersion systems were prepared. In each of the systems, the glass fibers were sized with a different size composition, these compositions being as listed below. Visual dispersion evaluations were made at 5, 15 an 30 and/or 60 minutes. Inasmuch as the chopping efficiency was not, in all instances, equivalent, a chopping evaluation was also made.

Data and results were as follows:

TABLE I

| | Component in Size, Wgt. Percent | | | | | | | Dispersion Evaluation | | | |
|---|---|---|---|---|---|---|---|---|---|---|---|
| Size | A | B | C | D | E | F | G | 5 Min. | 15 Min. | 30 & 60 Min. | Chopping Evaluation |
| 1 | 0 | 0 | 0 | 0.50 | 0.10 | 0.10 | 0 | Poor | Fair | Poor | Poor |
| 2 | 4.0 | 0 | 0 | 0 | 0 | 0.10 | 10.0 | Good | Good | Good | Fair |
| 3 | 0 | 0.08 | 0 | 0 | 0.10 | 0 | 10.0 | Poor | Poor | Poor | Poor |
| 4 | 4.0 | 0.08 | 0 | 0.50 | 0 | 0 | 0 | Fair | Poor | Poor | Fair |
| 5 | O | 0 | 0.10 | 0.50 | 0 | 0 | 10.0 | — | Good | Poor | Poor |
| 6 | 4.0 | 0 | 0.10 | 0 | 0.10 | 0 | 0 | Poor | Poor | Fair | Fair |
| 7 | 0 | 0.08 | 0.10 | 0 | 0 | 0.10 | 10.0 | Fair | — | Good | Poor |
| 8 | 4.0 | 0.08 | 0.10 | 0.50 | 0.10 | 0.10 | 0 | Poor | Good | Fair | Good |
| 9 | 4.0 | 0.08 | 0.10 | 0.50 | 0 | 0 | 0 | — | Fair | Fair | Good |

Component Identification
A - Polyvinyl acetate - (Resyn 25-1014 from National Starch)
B - Acetic Acid
C - Vinyl-tri(beta-methoxyethoxy)-silane-(A-172 from Union Carbide)
D - Polyethoxylated aliphatic amino - (Ethomeen S/15 from Armour Industrial Chemical Co.)
E - n-aminopropyltrimethoxysilane - (A 1100 from Union Carbide Corp.)
F - Methyl trimethoxysilane with 0.027 wgt. % acetic acid (Based on weight of Size (76070 from Dow Corning)
G - Malto-dextrin - (Mar Rex 1918 from Corn Products Corp.)

It can be seen from the above data that size 2 produced the best results, the size comprising 0.10 weight percent methyl trimethoxysilane, 10 weight percent malto-dextrin and 4 weight percent polyvinyl acetate.

EXAMPLE II

Based upon the results set forth in the previous table, various size compositions were prepared, the size compositions differing only with respect to the amounts of methyl trimethoxysilane, polyvinyl acetate and malto-dextrin. All dispersion systems were prepared in the same manner in order to determine the best mode of practicing the invention insofar as the composition of the size was concerned. Results were as follows:

TABLE II

| Size | Component in Size, Weight Percent A | B | C | Dispersion Evaluation 5 & 15 Min. | 30 & 60 Min. | Chopping Evaluation |
|---|---|---|---|---|---|---|
| 1 | 5 | 2 | 0 | Poor | — | Fair |
| 2 | 10 | 2 | 0 | Fair | Fair | Fair |
| 3 | 5 | 4 | 0 | Poor | Poor | Fair |
| 4 | 10 | 4 | 0 | Fair | Poor | Fair |
| 5 | 5 | 2 | 0.1 | Fair | Fair | Fair |
| 6 | 10 | 2 | 0.1 | Good | Good | Bad |
| 7 | 5 | 4 | 0.1 | Fair | Good | Bad |
| 8 | 10 | 4 | 0.1 | Fair | Good | Fair |

Component Identification
A - Malto-dextrin - (Mar Rex 1918)
B - Polyvinyl acetate - (Resyn 25-1014)
C - Methyl trimethoxysilane - (Z6070)

It can be seen from the above data that best results were obtained. employing a size composition comprising the malto-dextrin in an amount of about 10 weight percent, th polyvinyl acetate in an amount of about 2 weight percent and the methyl trimethoxysilane in an amount of about 0.1 weight percent.

It is evident from the above that various modifications can be made to this invention. Such, however, are considered to be within the scope of the invention.

What is claimed is:

1. A method of producing a glass mat which comprises:

a. dispersing a plurality of glass fibers in an aqueous composition to form a dispersion, said glass fibers having at least a portion of their surface in contact with an effective amount of a size comprising a methyl trimethoxysilane and a malto-dextrin, said dispersion comprising an effective amount of a nonionic guar gum and an isostearic amide;

b. withdrawing water from said dispersion to produce a glass mat; and, c. recovering said glass mat.

2. The method of claim 1 in which said size comprises a polyvinyl acetate.

3. The method of claim 1 in which said isostearic amide is isostearic dimethanol amide.

4. A composition comprising a plurality of glass fibers at least a portion of the surfaces of said fibers being in contact with an effective amount of a size comprising a methyl trimethoxysilane and a malto-dextrin, said fibers being dispersed in an aqueous system comprising an effective amount of a nonionic guar gum and an isostearic amide.

5. The composition of claim 4 in which said size comprises a polyvinyl acetate.

6. The composition of claim 4 in whch said isostearic amide is isostearic dimethanol amide.

7. The composition of claim 1 in which said size comprises polyvinyl acetate.

8. The composition of claim 4 in which said size is the residue from an aqueous composite comprising said methyl trimethoxysilane in an amount within the range of about 0.005 to about 0.5 weight percent and said malto-dextrin in an amount within the range of from about 5 to about 20 weight percent.

9. The method of claim 1 in which said size is the residue from an aqueous composite comprising said methyl trimethoxysilane in an amount within the range of from about 0.005 to about 0.5 weight percent and said malto-dextrin in an amount within the range of from about 5 to about 20 weight percent.

10. The method of claim 7 in which said methyl trimethoxysilane is present in an amount of about 0.1 weight percent and said malto-dextrin is present in an amount of about 10 weight percent.

* * * * *